US005664986A

United States Patent [19]

Roh

[11] Patent Number: 5,664,986

[45] Date of Patent: Sep. 9, 1997

[54] APPARATUS FOR POLISHING A DIELECTRIC LAYER FORMED ON A SUBSTRATE

[75] Inventor: Jae-Woo Roh, Seoul, Rep. of Korea

[73] Assignee: Daewoo Electronics Co., Ltd., Seoul, Rep. of Korea

[21] Appl. No.: 563,170

[22] Filed: Nov. 27, 1995

[30] Foreign Application Priority Data

Feb. 15, 1995 [KR] Rep. of Korea ..... 95-2765

[51] Int. Cl.[6] ..... B24B 49/00

[52] U.S. Cl. ..... 451/7; 451/285

[58] Field of Search ..... 451/7, 317, 285, 451/287, 288, 283, 53, 259, 270, 271, 278; 73/88.5 R; 219/449

[56] References Cited

U.S. PATENT DOCUMENTS

| | | | |
|---|---|---|---|
| 3,948,089 | 4/1976 | Shaw et al. | 73/88.5 R |
| 4,045,654 | 8/1977 | Eide | 219/449 |
| 5,113,622 | 5/1992 | Nishiguchi et al. | 451/285 |
| 5,127,196 | 7/1992 | Morimoto et al. | 451/7 |
| 5,476,414 | 12/1995 | Hirose et al. | 451/288 |

FOREIGN PATENT DOCUMENTS

| | | | |
|---|---|---|---|
| 404053671 | 2/1992 | Japan | 451/7 |

*Primary Examiner*—James G. Smith
*Assistant Examiner*—Derris H. Banks
*Attorney, Agent, or Firm*—Anderson Kill & Olick P.C.

[57] ABSTRACT

An apparatus for polishing a dielectric layer deposited on a top surface of a semiconductor substrate includes a table, a semiconductor substrate, a carrier, a pipe, a nozzle and an actuator assembly provided with a base, a power source, a cavity and a thermally expanding material. The actuator assembly controls the vertical position of the table by supplying a current to the thermally expanding material.

13 Claims, 3 Drawing Sheets

APPARATUS FOR POLISHING A DIELECTRIC LAYER FORMED ON A SUBSTRATE

FIELD OF THE INVENTION

The present invention relates to an apparatus for processing a semiconductor; and, more particularly, to an apparatus for polishing a dielectric layer formed on a substrate.

DESCRIPTION OF THE PRIOR ART

There is shown in FIG. 1 a polishing apparatus capable of planarizing a dielectric layer formed on a substrate, as disclosed in U.S. Pat. No. 5,127,196, issued to Seiichi Morimoto, et el., entitled "APPARATUS FOR PLANARIZING A DIELECTRIC FORMED OVER A SEMICONDUCTOR SUBSTRATE". The polishing apparatus 100 comprises a table 20, a semiconductor substrate 23, a carrier 24, a heat exchanger 26, a first and a second pipes 32, 36, a refrigeration unit 35 and a nozzle 38. In the polishing apparatus 100, the semiconductor substrate 23 is placed face down on the table 20 during planarization. The table 20 includes a pad 21 fixedly attached to the top surface thereof. The pad 21 made of a porous material contacts the upper surface of the dielectric layer formed on the semiconductor substrate 23. The porous material is capable of absorbing particulate matters such as silica or other abrasive materials.

The carrier 24 is used to apply a downward pressure $F_1$ against the backside of the semiconductor substrate 23 which is held in contact with the bottom of carrier 24 by a vacuum or simply by a wet surface tension. Preferably, an insert pad 30 cushions the semiconductor substrate 23 from the carrier 24. An ordinary retaining ring 29 is employed to prevent the semiconductor substrate 23 from slipping laterally from the carrier 24. The applied downward pressure $F_1$ is typically on the order of 5 pounds per square inches and is applied by means of a shaft 27 attached to the backside of the carrier 24. This pressure is used to facilitate an abrasive polishing of the upper surface of the dielectric layer.

Meanwhile, the refrigeration unit 35 chills a coolant as it flows through the first pipe 32. The first pipe 32 passes through the interior of the table 20 so that the temperature of the table 20 may be reduced below room temperature during the polishing process. In the polishing apparatus 100, the coolant includes an ordinary water whose temperature is controlled by the refrigeration unit 35 so that the temperature of the table 20 is maintained at approximately 10 degrees throughout the polishing process. The refrigeration unit 35 also provides the means by which the coolant is circulated through the first pipe 32 and the table 20.

The second pipe 36 delivers the abrasive material onto the surface of the pad 21 during the polishing process. The abrasive material is preferably delivered in a liquid suspension called a "slurry" to facilitate the polishing process. After being pumped through the second pipe 36, the slurry is directed onto the surface of the pad 21 by the nozzle 38.

During operation, the carrier 24 typically rotates in a circular motion relative to the table 20. This rotational movement is commonly provided by coupling an ordinary motor to the shaft 27. And also, the table 20 is rotated by well-known mechanical means to thereby allow the polishing apparatus 100 to planarize the dielectric layer formed on the semiconductor substrate 23.

One of the major shortcomings of the above-described polishing apparatus is that it is not easy to control precisely the thickness of the dielectric layer to be polished therewith, since it involves a precise control of the polishing time and the applied pressure.

SUMMARY OF THE INVENTION

It is, therefore, a primary object of the invention to provide an apparatus which is capable of controlling the thickness of a dielectric layer to be polished.

In accordance with the present invention, there is provided a polishing apparatus capable of providing a precise thickness of control of a dielectric layer deposited on a top surface of a semiconductor substrate during a polishing thereof, comprising: a table having a top and a bottom surfaces, wherein the top surface has a porous material capable of absorbing particulate matters; means for holding the semiconductor substrate, wherein the holding means includes a carrier having a top and a bottom surfaces, a shaft coupled to the top surface of the carrier, an insert pad attached to the bottom surface of the carrier and a retaining ring connected to an outer line of the bottom surface thereof to hold the semiconductor substrate; means for moving the holding means toward the top surface of the table and for locking the holding means at a predetermined position so that the dielectric layer is placed at the predetermined position from the top surface of the table; means for delivering an abrasive material to the top surface of the table; means for rotating the holding means to cause a friction between the abrasive material and the dielectric layer; means for controlling a vertical position of the table, wherein the vertical position controlling means is attached to the bottom surface of the table; and a cavity for enclosing the vertical position controlling means, wherein the cavity is made of a heat insulating material to thereby keep the temperature inside of the cavity constant.

BRIEF DESCRIPTION OF THE DRAWINGS

The present invention together with the above and other objects and advantages will become apparent from the following description of preferred embodiments given in conjunction with the accompanying drawings, wherein.

DETAILED DESCRIPTION OF THE PREFERRED EMBODIMENTS

Figure 1:
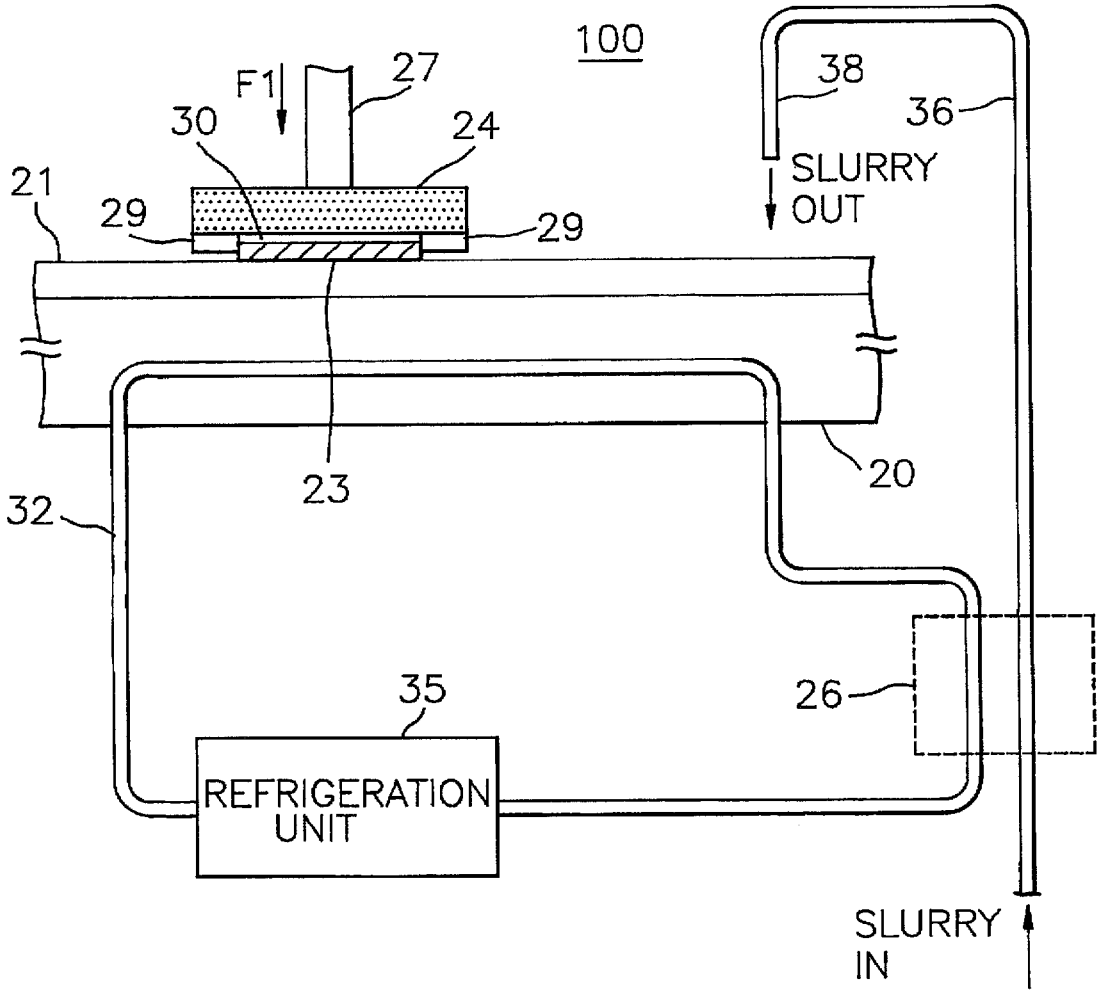
FIG. 1 (PRIOR ART)
FIG. 1 represents a schematic view of a prior art polishing apparatus.
Figure 2:
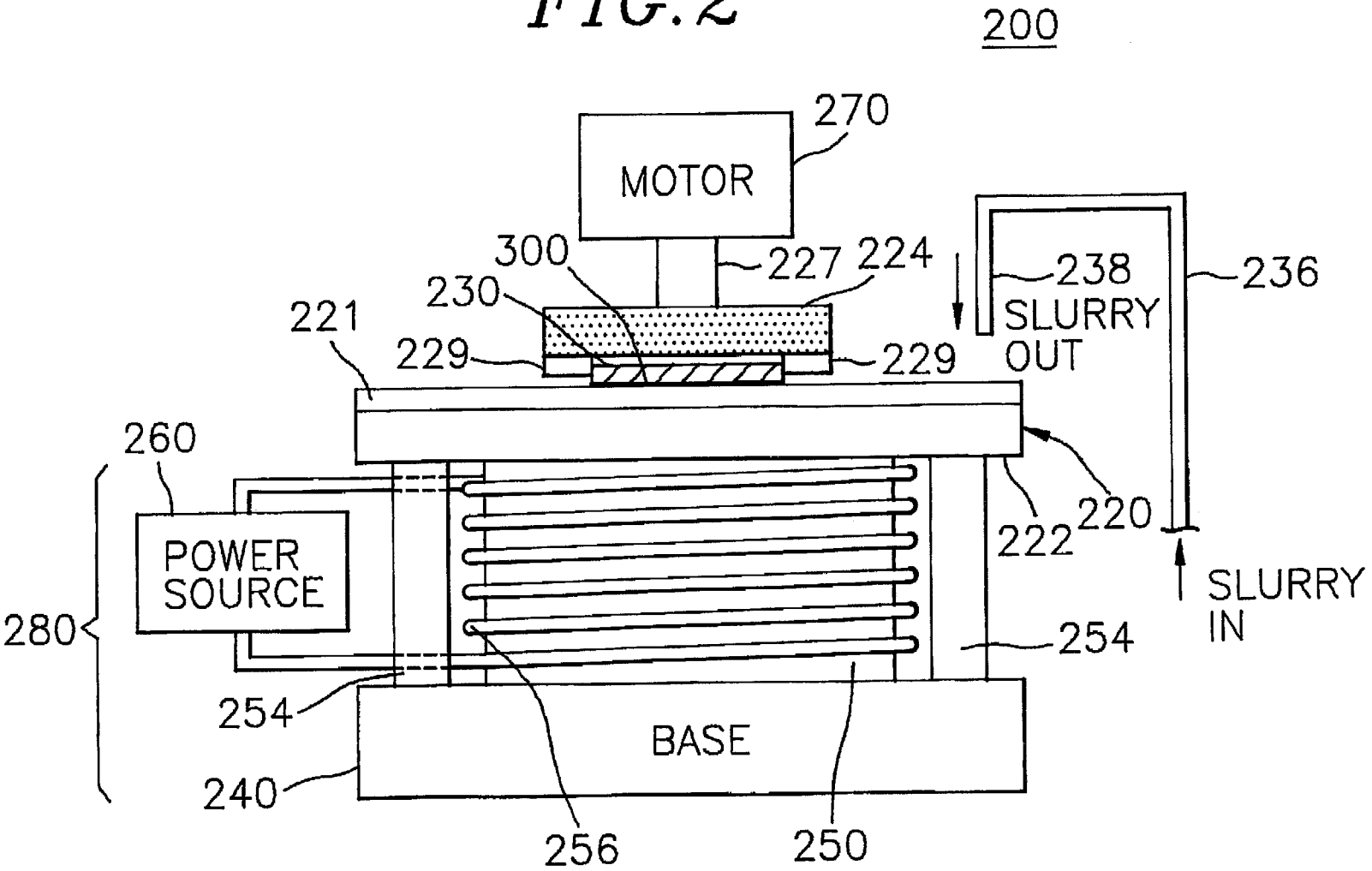
FIG. 2 provides a schematic view of a polishing apparatus in accordance with the present invention.

Referring to FIG. 2, there is shown an apparatus for polishing a dielectric layer formed on a substrate in accordance with a preferred embodiment of the present invention.

The polishing apparatus 200 comprises a table 220 including a top and a bottom surfaces 221, 222, a carrier 224 used for holding a semiconductor substrate 300 and including a retaining ring 229 and an insert pad 230, a pipe 236, a nozzle 238 and an actuator assembly 280 including a base 240, a thermally expanding material 250, a cavity 254, a heating coil 256 and a power source 260.

In the polishing apparatus 200, the semiconductor substrate 300 is placed face down on the table 220 during polishing process. The top surface 221 of the table 220 is made of a porous material which contacts the dielectric layer formed on the semiconductor substrate 300. The porous material is capable of absorbing particulate matters such as silica or other abrasive materials.

The semiconductor substrate 300 is held by the carrier 224 having a top and a bottom surfaces. The semiconductor substrate 300 is attached to the bottom surface of the carrier 224 by a vacuum or a wet surface tension. The retaining ring 229 is connected to an outer line of the bottom surface of the carrier 224 to prevent the semiconductor substrate 300 from slipping laterally from the carrier 224. The insert pad 230 is attached to the center portion of the bottom surface of the carrier 224 for cushioning the semiconductor substrate 300 from the bottom surface of the carrier 224. A shaft 227 links the top surface of the carrier 224 to a motor 270 to thereby allow the carrier 224 to move toward the top surface 221 of the table 220 at a predetermined position along the shaft 227. And then, the carrier 224 is locked at the predetermined position by well-known mechanical means (not shown).

Meanwhile, the pipe 236 delivers the abrasive material onto the top surface 221 of the table 220 during polishing process. The abrasive material is preferably delivered in a liquid suspension called a "slurry" to facilitate the polishing process. After being pumped through the pipe 236, the slurry is directed onto the top surface 221 of the table 220 through the nozzle 238.

During operation, the carrier 224 typically rotates in a circular motion relative to the table 220 to cause a friction between the abrasive material and the dielectric layer. This rotational movement is commonly provided by coupling the motor 270 to the shaft 227.

Figure 3:
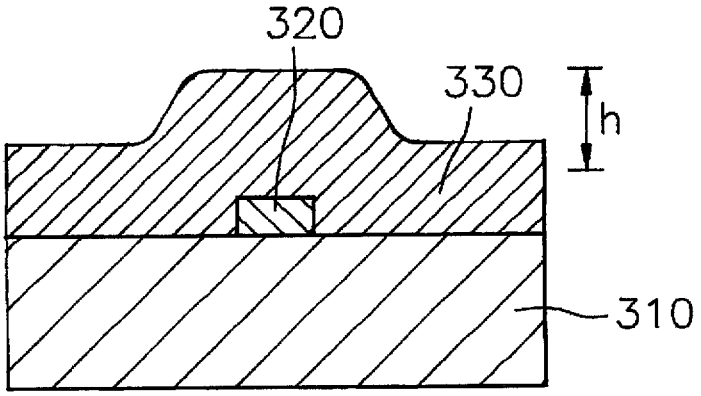
FIG. 3 depicts a cross-sectional view of a semiconductor substrate following deposition of a dielectric layer.

The actuator assembly 280 for controlling a vertical movement of the table 220 is connected to the bottom surface 222 of the table 220. The thermally expanding material 250 is disposed between the base 240 and the bottom surface 222 of the table 220. The notation h in FIG. 3 represents a portion of the dielectric layer to be polished by the polishing apparatus 200.

Table shown below depicts a relationship between the vertical movement of the table 220 and the thermally expanding material 250. If the thermally expanding material 250 is made of zirconium(Zr) and the thickness of the thermally expanding material 250 is 1 cm, the table 220 moves 420Å for every one degree change in temperature.

TABLE

| Thermally expanding material | Thermal expansion coefficient | Vertical movement rate |
|---|---|---|
| Fused silica glass | $0.5 \times 10^{-6}$ cm/cm · °C. | 50 Å/cm · °C. |
| Zirconium (Zr) | $4.2 \times 10^{-6}$ cm/ · °C. | 420 Å/cm · °C. |
| Boron carbide ($B_4C$) | $4.5 \times 10^{-6}$ cm/ · °C. | 450 Å/cm · °C. |
| Silicon.carbide (SiC) | $4.7 \times 10^{-6}$ cm/ · °C. | 470 Å/cm · °C. |
| Aluminum oxide ($Al_2O_3$) | $8.8 \times 10^{-6}$ cm/ · °C. | 880 Å/cm · °C. |

The power source 260 connected to the heating coil 256 supplies an electric current to the heating coil 256 to thereby allow the heating coil 256 to heat the thermally expanding material 250. Accordingly, the thermally expanding material 250 is expanded by the corresponding amount of the heat from the heating coil 256. The thermal expansion material 250 is surrounded with the cavity 254 made of a heat insulating materials so as to prevent the heat from radiating away and keep the temperature constant inside the cavity 254.

Referring to FIG. 3, a cross-sectional view of a semiconductor substrate is shown immediately after a deposition of the dielectric layer 330, before the polishing process. The metal line 320 is provided on a flat top surface of a substrate 310. The metal line 320 is formed by using a conventional photolithography method. In a subsequent step, the dielectric layer 330, e.g., made of silicon oxide, is formed on top of the metal line 320 and the substrate 310 by using, e.g., a chemical vapor deposition method. It is preferable that the thickness of the dielectric layer 330 is greater than the thickness of the metal line 320. Due to the fact that the metal line 320 is located on the top surface of the substrate 310, the dielectric layer 330 formed will not be flat. There will be a slight protrusion at a portion of the dielectric layer corresponding to the metal line 320. Hence, the dielectric layer 330 must be polished prior to a practical application thereof. The notation h represents the portion of the dielectric layer to be polished by the apparatus.

Figure 4:
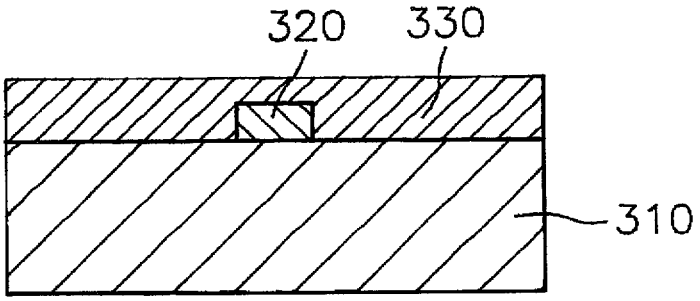
FIG. 4 shows a cross-sectional view of the semiconductor substrate following a polishing process in accordance with the present invention.

In FIG. 4, a cross-sectional view of the semiconductor substrate 300 of FIG. 3 is shown after the polishing process in accordance with the present invention.

In comparison with the prior art polishing apparatus, the inventive apparatus includes an actuator assembly 280 capable of precisely controlling the vertical position of the table 200, and hence the thickness of a polished dielectric layer. This is achieved by utilizing the thermally expanding material 250.

While the present invention has been shown and described with respect to the preferred embodiments, it will be apparent to those skilled in the art that many changes and modifications may be made without departing from the spirit and scope of the invention as defined in the appended claims.

What is claimed is:

1. An improved polishing apparatus for polishing a dielectric layer deposited on a top surface of a semiconductor substrate, the apparatus having a base provided with a top and a bottom surfaces, a table placed on the top surface of the base and provided with a top surface made of a porous material capable of absorbing particulate matters and a bottom surface, means for holding the semiconductor substrate, means for delivering an abrasive material to the top surface of the table, means for rotating the holding means to cause a friction between the abrasive material and the dielectric layer, the rotating means being fixed on a predetermined position from the bottom surface of the base, wherein the improvement comprises:

thermally expanding means disposed between the top surface of the base and the bottom surface of the table;

heat insulating means, encompassing the thermally expanding means, for maintaining the temperature inside the thermally expanding means substantially constant; and means for applying heat to the thermally expanding means to thereby control a vertical position of the table.

2. The apparatus of claim 1, wherein the vertical position of the table is defined by a distance between the bottom surface of the base and the top surface of the table.

3. The apparatus of claim 1, wherein the heating means includes a power source and a heating coil.

4. The apparatus of claim 1, wherein the thermally expanding means is made of aluminum oxide($Al_2O_3$).

5. The apparatus of claim 1, wherein the thermally expanding means is made of zirconium(Zr).

6. The apparatus of claim 1, wherein the thermally expanding means is made of silicon carbide(SiC).

7. The apparatus of claim 1, wherein the thermally expanding means is made of fused silica glass.

8. A polishing table for use in a polishing apparatus, comprising:

a table having a bottom surface;

a base having a bottom surface;

thermally expanding means disposed between the base and the bottom surface of the table, for controlling the height of the table, wherein the height is defined by a length between the bottom surface of the base and the top surface of the table;

heat insulating means, enclosing the thermally expanding means, for maintaining substantially constant the temperature inside the thermally expanding means; and means for applying a heat to the thermally expanding means to thereby control a vertical position of the table.

9. The apparatus of claim 8, wherein the heating means includes a power source and a heating coil.

10. The apparatus of claim 8, wherein the thermally expanding means is made of aluminum oxide($Al_2O_3$).

11. The apparatus of claim 8, wherein the thermally expanding means is made of zirconium(Zr).

12. The apparatus of claim 8, wherein the thermally expanding means is made of silicon carbide(SiC).

13. The apparatus of claim 8, wherein the thermally expanding means is made of fused silica glass.

* * * * *